US006622875B2

(12) United States Patent
Humphrey

(10) Patent No.: US 6,622,875 B2
(45) Date of Patent: Sep. 23, 2003

(54) SHADE DISPLAY ASSEMBLY

(75) Inventor: Neall W. Humphrey, El Dorado Hills, CA (US)

(73) Assignee: Trade Source International, Coppell, TX (US)

( * ) Notice: Subject to any disclaimer, the term of this patent is extended or adjusted under 35 U.S.C. 154(b) by 0 days.

(21) Appl. No.: 10/010,400

(22) Filed: Dec. 5, 2001

(65) Prior Publication Data

US 2003/0102276 A1 Jun. 5, 2003

(51) Int. Cl.[7] ..... A47F 7/00

(52) U.S. Cl. ..... 211/85.14; 211/59.1; 211/87.01

(58) Field of Search ..... 211/85.14, 59.1, 211/87.01, 113.1, 32; 248/126, 220.21, 220.22, 220.3, 221.11, 220.41; 40/642.01, 657

(56) References Cited

U.S. PATENT DOCUMENTS

| | | | | | |
|---|---|---|---|---|---|
| 939,815 | A | * | 11/1909 | Dumond | 248/254 |
| 2,157,001 | A | * | 5/1939 | Morley | 248/205.6 |
| 2,296,073 | A | * | 9/1942 | Walgo | 30/410 |
| 2,513,474 | A | * | 7/1950 | Greer | 211/50 |
| 2,746,661 | A | * | 5/1956 | Kaplan | 224/551 |
| 3,912,084 | A | * | 10/1975 | Valiulis | 248/220.22 |
| 4,773,172 | A | * | 9/1988 | Fast | 40/657 |
| 4,882,868 | A | * | 11/1989 | Fast | 40/642.01 |
| 4,987,692 | A | * | 1/1991 | Fast | 40/657 |
| 5,088,606 | A | * | 2/1992 | Boas | 211/57.1 |
| 5,123,189 | A | * | 6/1992 | Fast et al. | 40/642.01 |
| 5,235,766 | A | * | 8/1993 | Fast et al. | 40/642.01 |
| 5,390,837 | A | * | 2/1995 | Ruffolo, Jr. | 224/482 |
| D357,557 | S | * | 4/1995 | Piper | D30/133 |
| 5,538,144 | A | * | 7/1996 | Reed | 211/32 |
| 5,833,186 | A | * | 11/1998 | Kosmoski et al. | 248/221.11 |
| 5,996,819 | A | | 12/1999 | Klein | 211/85 |
| 6,003,685 | A | * | 12/1999 | Malin | 211/7 |
| 6,182,841 | B1 | * | 2/2001 | Klein | 211/85.14 |
| 6,257,535 | B1 | * | 7/2001 | Jaing | 248/205.5 |

* cited by examiner

*Primary Examiner*—Daniel P. Stodola
*Assistant Examiner*—Khoa Tran
(74) *Attorney, Agent, or Firm*—Louis J. Bovasso; Greenberg Traurig LLP

(57) ABSTRACT

A shade display assembly wherein a rack is mounted to a preexisting display, such as pegboard, in a retail store or the like. The rack has a post on which a shade can be displayed so that it is viewable from all angles. The post extends through the center ring of the hoop of the shade.

6 Claims, 3 Drawing Sheets

FIG. 3
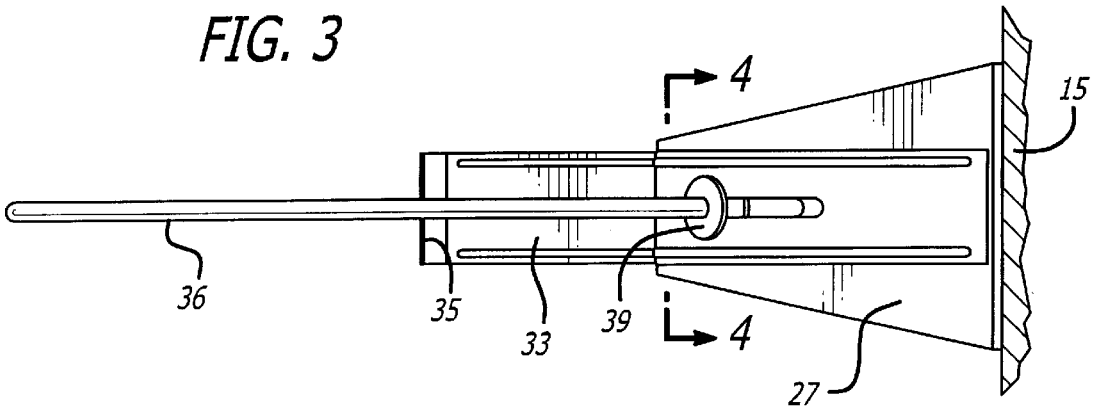
FIG. 5
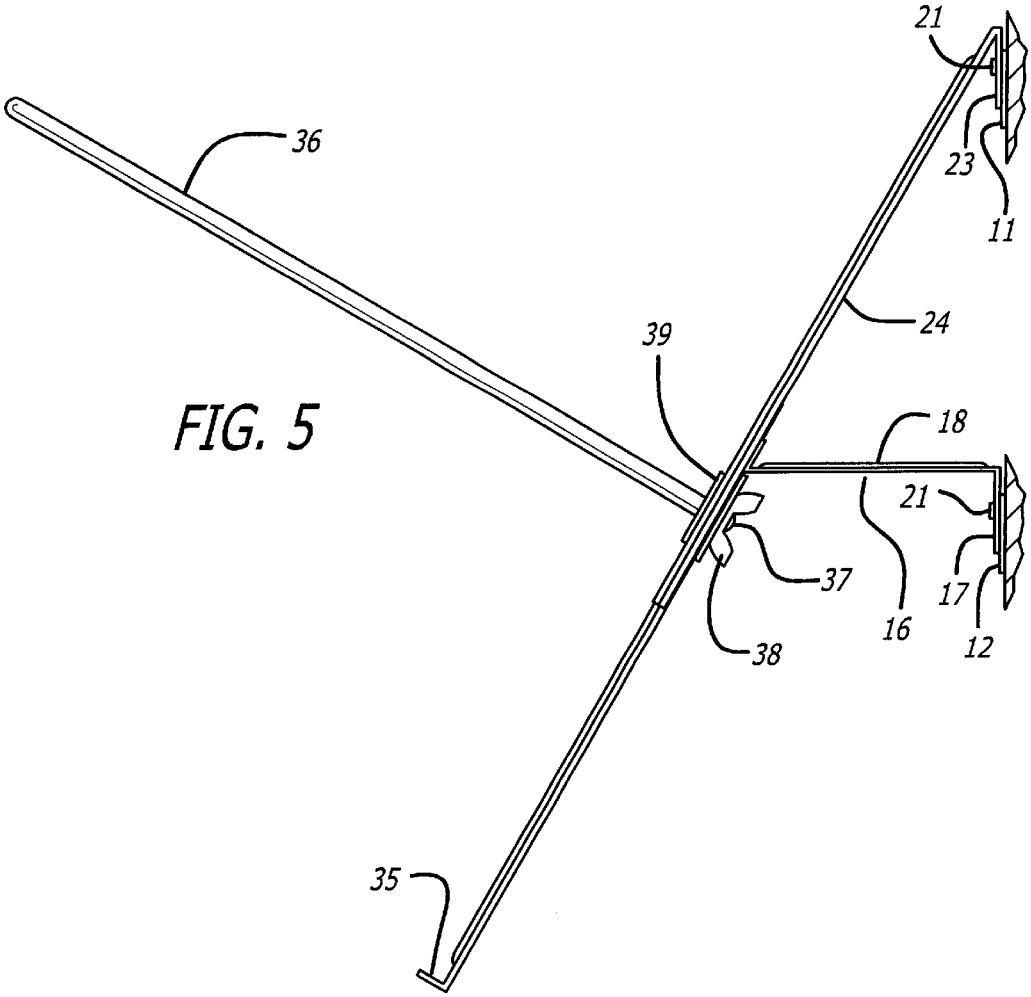
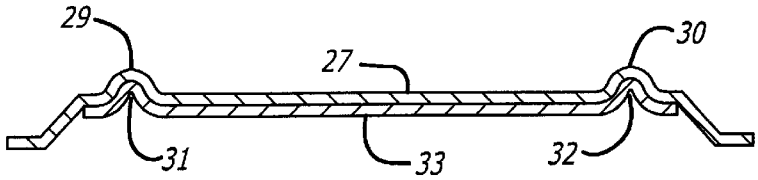
FIG. 4

FIG. 6
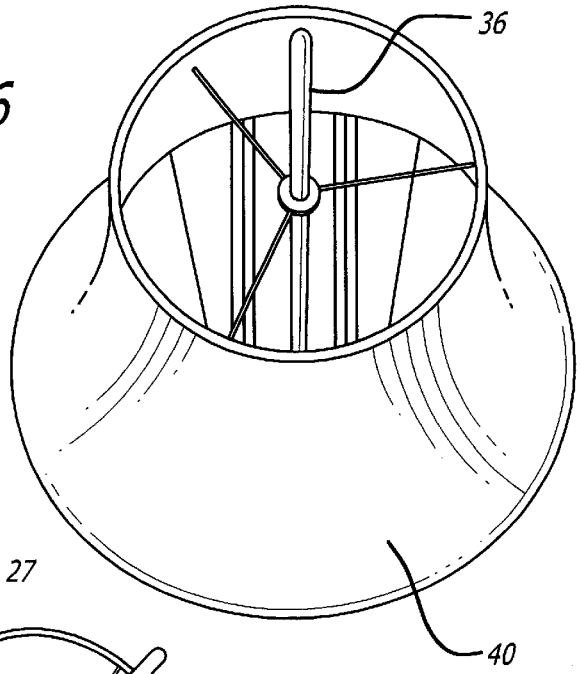
FIG. 7
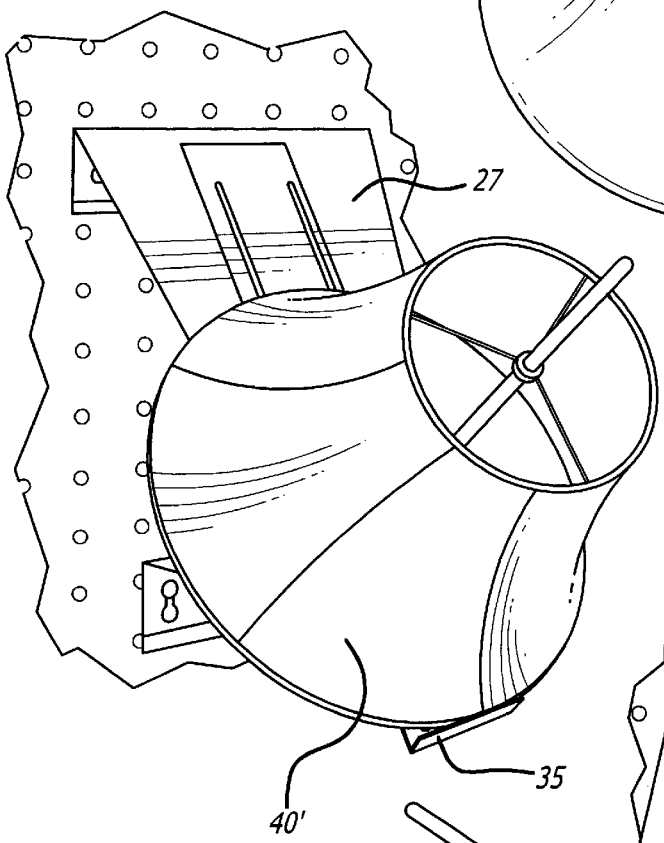
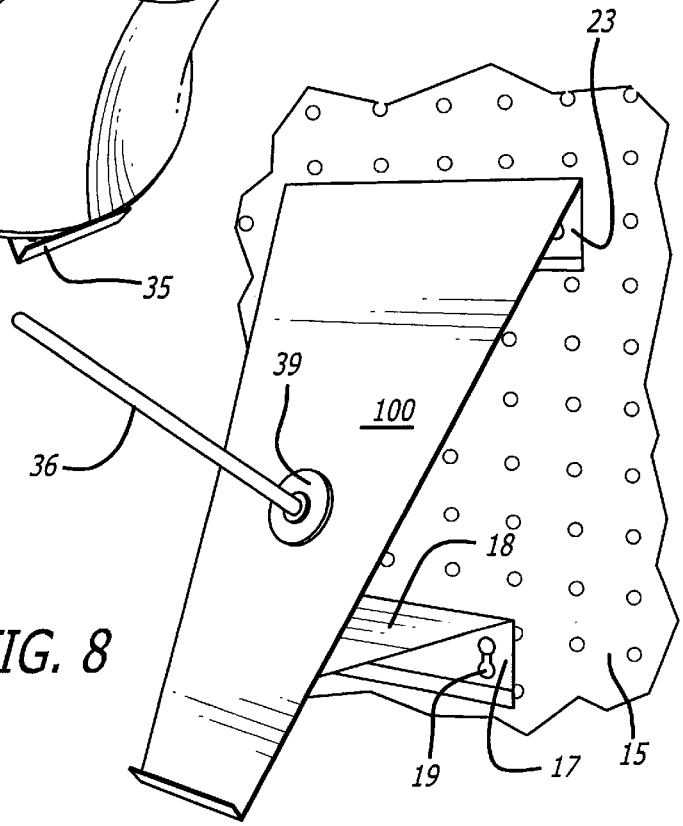
FIG. 8

SHADE DISPLAY ASSEMBLY

BACKGROUND OF THE INVENTION

1. Field of the Invention

The invention relates to store displays; and, more particularly, to a rack adapted to be mounted to a preexisting display panel, such as pegboard, in a retail store or the like to display a shade thereon.

2. General Background and State of the Art

It is important that shades be displayed to a potential buyer in a retail store so that the purchaser can make an intelligent discussion about what type or style of shade to buy. Generally, such shades are merely displayed in position on a lamp or the like on a shelf. This takes up quite a bit of room where, for example, a particular lamp may have a number of differently styled shades that can be used with it. If the shades, which are delicate, are merely placed on a shelf, the purchaser may not be able to view the entire shade. Also, the shades will be knocked against one another damaging the same.

There is thus a need for a shade display assembly that can be mounted to a preexisting display panel, such as pegboard, in a store or the like, to display a shade thereon.

INVENTION SUMMARY

It is an object of this invention to provide a shade display assembly that can be mounted to a preexisting display panel, such as pegboard, in a store or the like.

It is another object of this invention wherein the shade display assembly displays a shade in a pleasing manner for viewing by a potential purchaser.

It is still another object of this invention to carry out the foregoing objects wherein the shade is secured in place on the shade display assembly.

These and other objects are preferably accomplished by providing a shade display assembly wherein a rack is mounted to a preexisting display, such as pegboard, in a retail store or the like. The rack has a post on which a shade can be displayed so that it is viewable from all angles. The post extends through the center ring of the hoop of the shade.

BRIEF DESCRIPTION OF THE DRAWINGS

FIG. 3 is a top plan view of the assembly of FIG. 2;

FIG. 4 is a view taken along lines 4—4 of FIG. 3;

FIG. 5 is a side view of the assembly of FIG. 2;

FIG. 6 is a top perspective view of the post of FIG. 2 extending through the hoop of a conventional shade;

FIG. 7 is a view similar to FIG. 1 illustrating the compaction of the lower panel into the upper panel to accommodate smaller shades; and FIG. 8 is a perspective view, similar to FIG. 2, showing a non-telescoping shade display assembly.

DETAILED DESCRIPTION OF THE PREFERRED EMBODIMENTS

Figure 1:
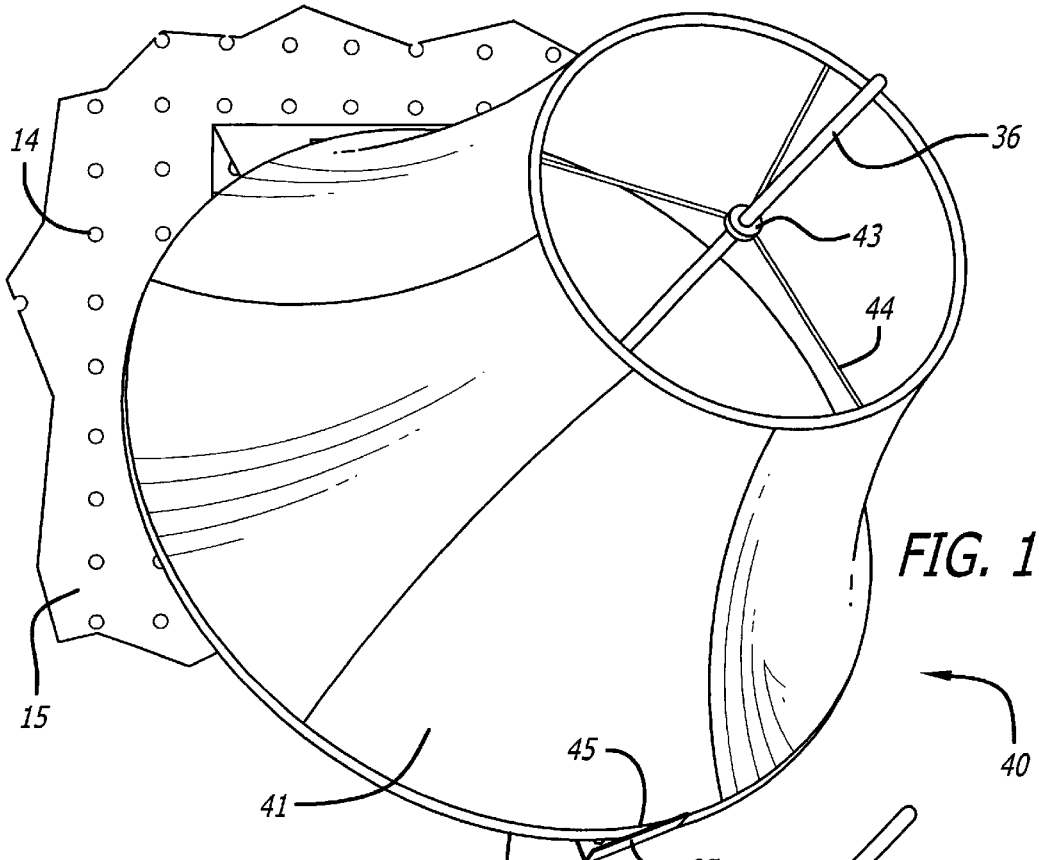
FIG. 1 is a perspective view of a shade display assembly in accordance with the teachings of the invention showing a large shade displayed thereon.
Figure 2:
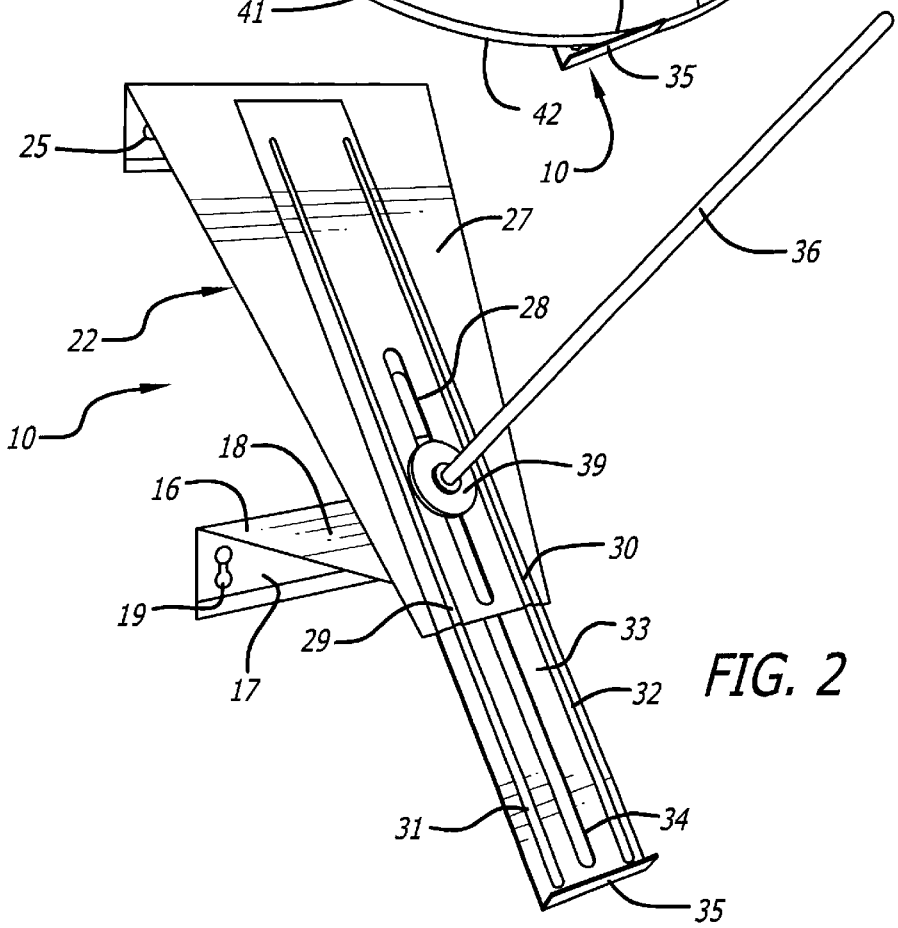
FIG. 2 is a perspective view of the shade display assembly alone of FIG. 1.

Referring now to FIG. 1 of the drawing, a shade display assembly 10 in accordance with the teachings of the invention is shown (see also FIG. 2). Shade display assembly 10 includes a pair of spaced flanges 11, 12 (FIG. 5), each flange 11, 12 adapted to be inserted into one of the holes 14 (FIG. 1) in a conventional preexisting pegboard 15 displayed in a retail store or the like.

A short angle bracket 16 (FIG. 5) has one end 17 extending at a right angle to main part 18, secured to flange 12 by one or more aligned elongated slots 19 (FIG. 2) in end 17 and flange 12 by suitable nuts and bolts 21 (FIG. 5).

A longer bracket 22 (FIG. 1) is provided spaced above bracket 16 having an end 23 at an angle, e.g., about 45°, from main elongated part 24. End 23 is secured to flange 11 by one or more aligned slots 25 (FIG. 2), in end 23 and flange 11 and connected by suitable nuts and bolts 21.

As seen in FIG. 2, a trapezoidally-shaped panel 27 is provided having an elongated slot 28 therethrough. Panel 27 has elongated grooves 29, 30 for receiving therein like spaced elongated ridges 31, 32 respectively, on a lower telescoping panel 33 (see also FIG. 4). Panel 33 also has therethrough an elongated slot 34 (FIG. 2) aligned with slot 28 in panel 27. Panel 33 is generally rectangularly-shaped and telescopes into the lower shorter side of panel 27 as shown. An upraised lip 35 at the terminal end of panel 33 provides a stop when panel 33 is telescoped into panel 27.

Part 18 (FIG. 1) of bracket 16 is connected to panel 27 at the bottom in any suitable manner, such as by welding if metallic materials are used, or by gluing if woods, plastics, etc., are used.

As seen in FIG. 5, an elongated support post 36 is provided having one end extending through aligned slots 28, 34 (see also FIG. 3). As seen in FIG. 5, post 36 extends through panel 27, 33 and terminates in a threaded end 37 having a wing nut 38 threaded thereon. A washer 39 encircles post 36 on the other side of panel 27 and thus, post 36 can be secured at any desired location along aligned slots 28, 34 while lower panel 33 is telescoped in and out of panel 27 as seen in FIG. 2.

Also as seen in FIGS. 2 and 5, post 36 extends at an angle from pegboard 15, e.g., about 45°. As seen in FIG. 1, a conventional shade 40 has a skirt 41 with a wire hoop 42 having a central ring 43 connected to hoop 42 by spaced ribs 44. Shade 40 is placed on post 36 by inserting the same through ring 43 (see also FIG. 6).

Shade 40 is seen in FIG. 1 as having its lower skirt portion 45 abutting against stop 35 of panel 33. FIG. 1 shows lower panel 33 fully extended out of panel 27 to accommodate large shades such as shade 40. As seen in FIG. 1, large shade 40 fills the widest telescoped area of panels 27 and 33.

As seen in FIG. 7, a smaller shade 40 may be displayed on panels 27, 33 in like manner when lower panel 33 is fully telescoped into panel 27 until lip 35 abuts against the bottom of the panel 27 as shown.

In both embodiments, more than one shade may be stacked on a single pole.

Although a telescoping arrangement is shown in FIGS. 1 to 7, as seen in FIG. 8, wherein like numerals refer to like parts of the embodiment of FIGS. 1 to 7, instead of telescoping panels 27, 33, a single panel 100, generally trapezoidally shaped, is providing also coupled to pegboard 15 by flanges 17, 23, and having a stop 101 at its lower end. A shade, not shown, can be mounted on part 36 as heretofore discussed. Part 36 may extend through a suitable hole in panel 100 and be secured thereto by washer 39 and a wing nut (not shown) on the other side of panel 100 as discussed with respect to FIG. 5.

It can be seen that there is disclosed a shade display assembly that can be made of any suitable materials, such as plastic, metal, etc. and display various sized shades thereon. The version of FIGS. 1 to 7 can be telescoped to compensate for shades of varying sizes. Large and small shades can be displayed for viewing without damaging other shades.

Although the brackets 17, 23 are shown mounted to flanges 11, 12 secured to pegboard, obviously other means may be used to mount the brackets 17, 23 to any suitable ,preexisting panel or rack in a retail store or the like. For example, clips may be used secured to the brackets 17, 23 to hang the same from a wire rack. Other means may be provided to secure the brackets to slat board or the like.

The invention herein has the following benefits over known prior art devices:

Fits more than one size of shade.

Saves shelf space which allows more shades to be shown.

Pole keeps shades aligned and organized.

Can be accommodated to preexisting structures, such as slat wall or peg board.

Angles the shade so it can be easily removed from the bracket, and allows the customer to have a better angle for viewing the shade.

It can hold a number of shades without any damage to the shades.

Customers are not required to pull the stack of shades off the shelf to get the top shade off the pile when there is a shelf above the stack of shades.

Pole can be extended to allow for larger shades, or to stack more shades.

Although a particular embodiment of the invention is disclosed, variations thereof may occur to an artisan and the scope of the invention should only be limited by the scope of the appended claims.

While the specification describes particular embodiments of the present invention, those of ordinary skill can devise variations of the present invention without departing from the inventive concept.

I claim:

1. A shade display rack for displaying at least one shade thereon comprising:

a first panel having a generally planar surface and securing means for securing the same to a preexisting display having a generally vertical planar surface in a retail store at one end thereof, said securing means being located on said first panel adjacent said display;

a post extending outwardly from said panel at an angle of about 90° with respect to said first panel away from said securing means for displaying a shade mounted thereon;

a second panel telescopingly mounted to said first panel, said post extending through aligned elongated slots in said first and second panels, both of said first and second panels being at an angle of about 45° with respect to said display planar surface: and a shade having a skirt portion, a hoop, a ring fixed to said hoop by a plurality of spaced ribs, said post extending through said ring.

2. The rack of claim 1 including a stop flange at the lowermost end of said second panel away from said first panel.

3. The rack of claim 2 wherein said securing means includes a pair of spaced brackets secured at one end to said first panel.

4. The rack of claim 3 wherein said spaced brackets include a first bracket at an angle of about 45° with respect to the plane of said first panel and a second bracket also at an angle of about 45° from the plane of said first panel.

5. The rack of claim 1 wherein said skirt portion abuts against a stop at the lowermost end of said second remote from said securing means.

6. The rack of claim 1 wherein said first panel is trapezoidally shaped having said securing means mounted thereon at its widest and narrowest ends.

* * * * *